US005823936A

United States Patent [19]

Ratzel

[11] Patent Number: 5,823,936

[45] Date of Patent: Oct. 20, 1998

[54] LOADING ASSEMBLY AND METHOD FOR CUSHIONING CONVERSION MACHINE

[75] Inventor: Richard O. Ratzel, Westlake, Ohio

[73] Assignee: Ranpak Corp., Painesville, Ohio

[21] Appl. No.: 598,669

[22] Filed: Feb. 8, 1996

[51] Int. Cl.[6] ..... B65H 49/00; B65H 45/00

[52] U.S. Cl. ..... 493/464; 226/92

[58] Field of Search ..... 493/346, 352, 493/381, 395, 459, 462, 464, 967; 226/91, 92

[56] References Cited

U.S. PATENT DOCUMENTS

| | | |
|---|---|---|
| 2,610,134 | 9/1952 | Hoblick . |
| 4,026,198 | 5/1977 | Ottaviano . |
| 4,147,287 | 4/1979 | Reba . |
| 4,650,456 | 3/1987 | Armington . |
| 4,750,896 | 6/1988 | Komaransky et al. . |
| 4,787,546 | 11/1988 | Bradbury . |
| 5,123,889 | 6/1992 | Armington et al. . |
| 5,211,620 | 5/1993 | Ratzel et al. . |
| 5,322,477 | 6/1994 | Armington et al. . |
| 5,387,173 | 2/1995 | Simmons, Jr. . |

FOREIGN PATENT DOCUMENTS

| | | |
|---|---|---|
| 0523382 | 6/1992 | European Pat. Off. . |
| 0679504A1 | 11/1995 | European Pat. Off. . |
| 2073712 | 10/1981 | United Kingdom . |
| 2097766 | 11/1982 | United Kingdom . |
| 9531296 | 11/1995 | WIPO . |

*Primary Examiner*—Jack W. Lavinder
*Attorney, Agent, or Firm*—Renner, Otto, Boisselle & Sklar, P.L.L.

[57] ABSTRACT

A cushioning conversion machine and method employing a loading assembly that eliminates the need to manually thread sheet-like stock material through a forming assembly of the machine during a loading operation. The loading assembly and associated method are characterized by cooperating feed members that are located adjacent an upstream or inlet end of a converging chute. Upon actuation of an accessible operator member, the feed members are selectively engaged to push stock material through the chute and out the exit end of the chute for engagement by a feeding/connecting assembly which is at least energized during such selective engagement.

16 Claims, 7 Drawing Sheets

LOADING ASSEMBLY AND METHOD FOR CUSHIONING CONVERSION MACHINE

FIELD OF THE INVENTION

The invention herein described relates generally to a cushioning conversion machine and, more particularly, to a loading assembly and method for loading sheet-like stock material in a cushioning conversion machine.

BACKGROUND OF THE INVENTION

In the process of shipping an item from one location to another, a protective packaging material is typically placed in a shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and composed of a renewable resource; making it an environmentally responsible choice for conscientious companies.

While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in commonly assigned U.S. Pat. No. 5,123,889. The therein disclosed cushioning conversion machine converts sheet-like stock material, such as paper in multi-ply form, into relatively low density pads. Specifically, the machine converts this stock material into a continuous unconnected strip having lateral pillow-like portions separated by a thin central band. This strip is coined along its central band to form a connected strip which is divided, as by cutting, into sections, or pads, of a desired length. The stock material preferably consists of three superimposed plies or layers of biodegradable, recyclable and reusable thirty-pound Kraft paper rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

The cushioning conversion machine disclosed in the above-identified patent includes a stock supply assembly, a forming assembly (also referred to as a former assembly or more simply a former), a feeding/connecting assembly and a cutting or severing assembly. The cushioning conversion machine further includes electrical circuitry which electrically controls the feeding/connecting assembly and the cutting assembly.

In preparation for operation of the machine, the machine is loaded with stock material. Stock material, in particular multi-ply (usually three ply) Kraft paper in roll form, is placed on a roll holder or cart for feeding into the machine.

The stock material is threaded through the forming assembly, typically by folding the leading end portion of the stock material in a triangular-like fashion and manually pushing this leading end portion through the forming assembly (e.g., a forming frame and a converging chute) so that the "point" of the triangle is positioned for engagement by the feed/connecting assembly. During the threading procedure, a top cover of the machine frame is pivoted about a hinge or otherwise opened to allow access to the forming assembly for loading the paper into the machine.

Sometimes, the conversion machine is mounted such that the top cover is not readily accessible. Under these circumstances the loading operation described above may be difficult as access to the forming assembly is limited. Therefore, it would be advantageous to be able to load the machine without having access to the top cover such that the stock material can be loaded without having to manually thread the stock material through the forming assembly.

RELATED APPLICATION

In copending application Ser. No. 08/478,008, which is hereby incorporated herein by reference in its entirety, there is disclosed a loading assembly for a cushioning conversion machine that eliminates the need to manually thread the stock material through the forming assembly of the machine. The loading assembly is disposed at one end of the machine and feeds the stock material through the forming assembly to the machine's feed assembly.

According to one aspect of the invention of the '008 application, a cushioning conversion machine which converts sheet-like stock material into a cushioning product comprises a forming assembly which forms the stock material into a strip of cushioning; a downstream feed assembly located at a downstream end of the forming assembly which feeds the strip of cushioning passing therethrough; a loader feed assembly located at an upstream end of the forming assembly, the loader feed assembly being operative, when engaged, to feed the stock material through the forming assembly to the feed assembly; and a loader operator assembly for selectively engaging and disengaging the loading assembly.

The loader operator assembly may include a lever movable between a non-load (disengaged) and load (engaged) position, and a position detect device which, when the lever is in its load position, effects energization of the downstream feed assembly. The loader feed assembly may include opposed rollers relatively movable towards and away from one another, and the loader operator may include a cam device connected to the lever for moving the opposed rollers towards and away from one another between engaged and disengaged positions. A crank may be provided for rotating at least one of the opposed rollers, the crank being connected to a shaft on which the one roller is mounted for rotation with the shaft. A plurality of pairs of opposed rollers may be provided, and the lever may be spring-biased so that the lever will return to the non-load position when released. The forming assembly may cause inward rolling of the lateral sides of the stock material to form a strip of cushioning, and the downstream feed assembly may operate to connect the strip of cushioning along a central band intermediate pillow-like portions, whereby a strip of cushioning product is formed. A cutting or severing assembly may also be provided to divide or separate the strip into sections.

Also disclosed in the '008 application is a method of converting a stock material into a cushioning product. The method comprises the steps of: inserting a leading end portion of the stock material into an upstream end of the machine; moving at least one roller into driving engagement with the leading end portion of the stock material; rotating the one roller, thereby feeding the stock material through the machine; then moving the one roller out of driving engagement with the stock material; and then operating the machine to produce a cushioning product. The step of rotating may be done manually as by turning a crank to rotate the one roller until the stock material engages a feed assembly downstream of the one roller. The method may further comprise the preliminary steps of loading a supply of stock material, such as a multi-ply roll of paper, onto a holder therefor, passing the several plies of paper through a ply separator assembly, and then folding the leading end portion into an arrow-shape for feeding through the machine in the aforesaid manner.

SUMMARY OF THE INVENTION

The present invention improves on the loader assembly and method disclosed in the '008 application. According to the present invention, a cushioning conversion machine which converts sheet-like stock material into a cushioning product generally comprises: a forming assembly which forms the stock material into a strip of cushioning; a loader feed assembly located at an upstream end of the forming assembly; and a loader operator assembly for selectively engaging and disengaging the loader feed assembly. The forming assembly includes a chute which has longitudinally extending, transversely converging opposed sides going from an inlet end to an outlet end of the chute, and the loader feed assembly includes cooperating feed members located adjacent the inlet end of the chute which, when engaged, feed the stock material into and through the chute, preferably to a downstream feed assembly.

In a preferred embodiment, the feed members are centered with respect to the opposed converging sides of the chute. The feed members preferably include a rotating feed wheel or roller, and a pressure wheel or roller, and the operator assembly includes an operator mechanism for moving the pressure wheel towards and away from the feed wheel. A preferred embodiment of operator mechanism includes a linkage and more particularly a toggle linkage, and a push rod connected to the toggle linkage. The push rod has a push knob at one end conveniently located at an accessible location at the rear of the machine proximate an opening in the machine's housing through which the stock material enters into the housing. The loader operator assembly preferably further comprises a position detect device operative, when the feed members are engaged, to effect energization of both the feed wheel and the feeding, or a feeding/connecting, assembly.

According to another aspect of the invention, there is provided a method of converting sheet-like stock material into a cushioning product. The method comprises the steps of: inserting a leading end portion of the stock material into an upstream end of the machine to a position adjacent the inlet end of a shaping chute having longitudinally extending, transversely converging opposed side walls; drivingly engaging the leading end portion of the stock material with a loader feed; operating the loader feed to advance the leading end portion of the stock material through the chute and preferably to a downstream feed assembly for engagement by the downstream feed assembly; after such engagement of the leading end portion of the stock material with the downstream feed assembly, disengaging the loader feed with respect to the stock material; and then operating the machine to produce a cushioning product. The method may further comprise the preliminary steps of loading a supply of stock material, such as a multi-ply roll of paper, onto a holder therefor, passing the several plies of paper through a ply separator assembly, and then folding the leading end portion into an arrow-shape for feeding through the machine in the aforesaid manner.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
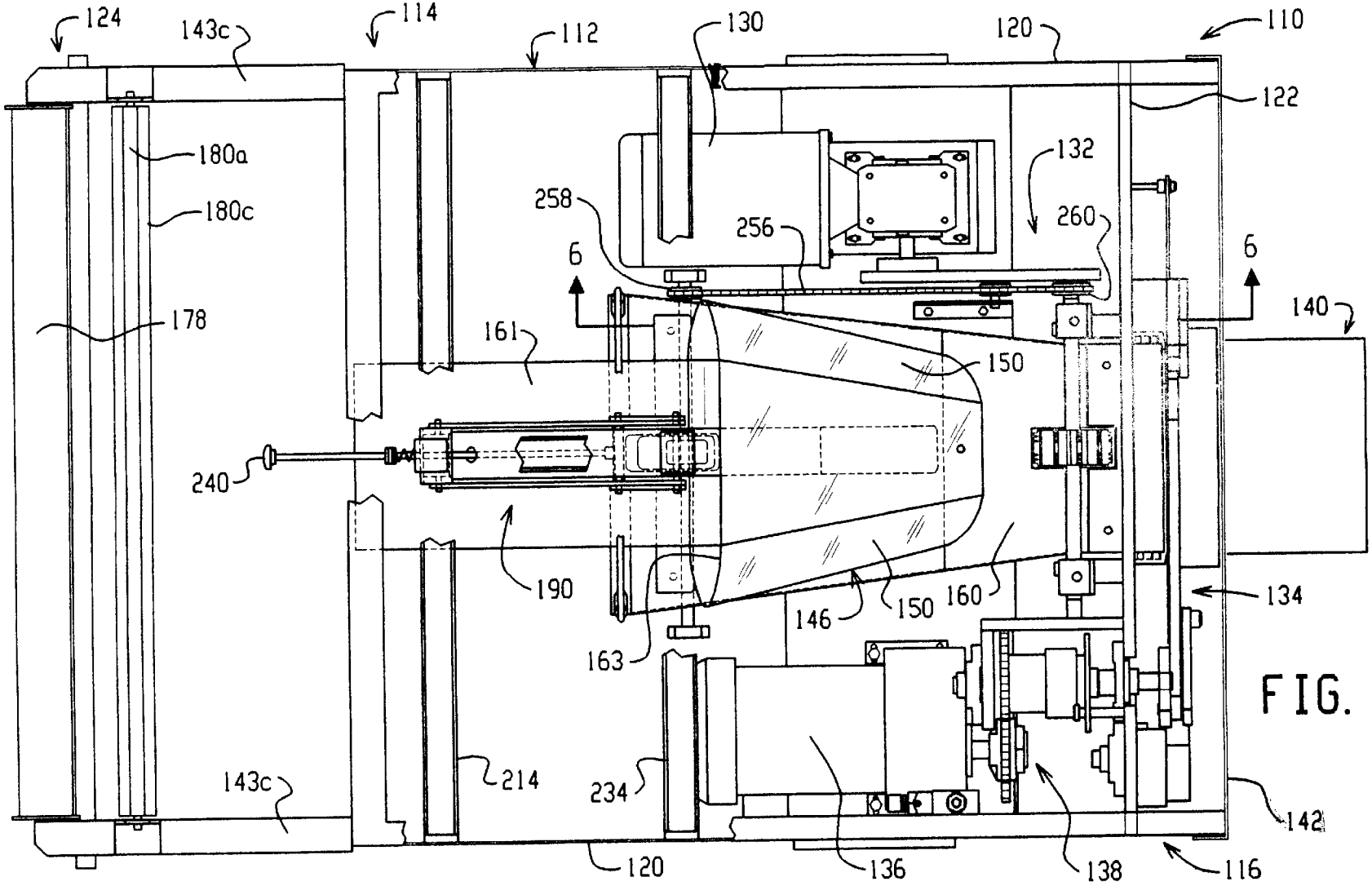
FIG. 1 is a top view of a cushioning conversion machine according to the present invention, with the top wall of the housing of the machine removed to show internal components of the machine including an automatic loading assembly.
Figure 2:
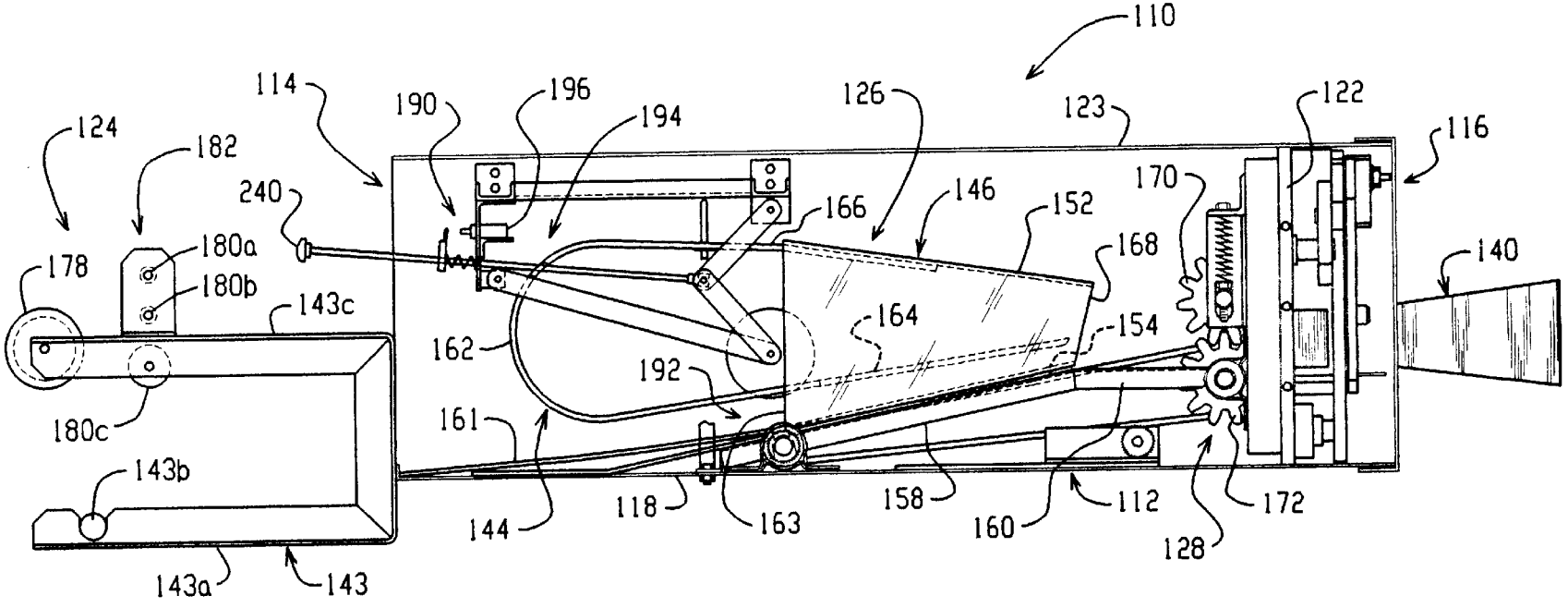
FIG. 2 is a side view of the machine shown in FIG. 1, with a side wall of the housing removed to show the internal components of the machine.

Referring now to the drawings in detail and initially to FIGS. 1 and 2, a preferred embodiment of a cushioning conversion machine according to the present invention is designated generally by reference number 110. The cushioning conversion machine 110 converts a sheet-like stock material, such as one or more layers of recyclable and reusable Kraft paper, into a dunnage product having, for example, lateral pillow-like portions separated by a thin central band. The dunnage product is used as an environmentally responsible protective packaging material typically used during shipping.

The machine 110 includes a housing, indicated generally at 112, having an upstream end 114 and a downstream end 116. The sheet-like stock enters the housing 112 through an opening at the upstream end thereof for passage through the housing where it is converted into a strip of cushioning that exits from the downstream end 116 of the housing. The housing includes base or bottom wall 118, side walls 120 and a downstream end plate 122 which together form a frame structure. The housing also includes a top wall 123 having an opening therein that is normally closed by a cover (not shown) that is hinged to the top wall for opening and closing, as in well-known manner. a generally rectangular outlet opening in the end plate 122 allows the strip of cushioning to pass therethrough.

The machine 110 further includes a stock supply assembly 124, a former or forming assembly 126, a feeding/connecting assembly 128 powered (energized) by a feed motor 130, for example an electric motor, through a motion transfer assembly 132, and a severing assembly 134 (for example a cutting assembly) powered by a motor 136 (for example an electric motor) through a solenoid and clutch assembly 138; all of which may be mounted to and/or in the housing 112 in well known manner. There may also be provided downstream of the severing assembly 134 a guide assembly, and more particularly a post-cutting constraining assembly 140. The guide or post-cutting constraining assembly may be mounted to a removable closure 142 at the downstream end 116 of the housing 112.

In the illustrated machine 110, the stock supply assembly 124 includes a stock roll mount formed by the lower horizontal legs 143*a* of laterally spaced-apart U-shape brackets 143. A roll of the stock material may be rotatably supported by a stock roller holder, such as a spindle 143*b*, extending between and supported by the legs 143*a* of the stock roll mount. As will be appreciated by those skilled in the art, a stock roll or other form of supply of sheet-like stock material, preferably multi-ply, may be used as a source of the stock material, such as a stock roll support cart preferably used for larger stock rolls. Also, the sheet-like stock material may be supplied in other forms, such as in a stack of fan-folded stock material as in the manner described in U.S. Pat. No. 5,387,173.

The forming assembly 126 includes a forming member 144 and a converging shaping chute 146. The illustrated forming assembly 126, which is further described in copending U.S. patent application Ser. No. 08/337,929, causes an inward rolling or folding of the lateral edges of the sheet-like stock material to form a continuous strip of cushioning having lateral pillow-like portions. The shaping chute 146 includes longitudinally extending, transversely converging side walls 150 which preferably are curved or arcuate in transverse cross-section. The side walls preferably are joined together by top and bottom walls 152 and 154 such that the chute is circumferentially continuous.

The shaping chute 146 has the bottom wall 154 thereof attached to an inclined ramp 158. The ramp 158 has a downstream extension or guide portion 160 for guiding the strip of cushioning exiting the downstream end of the shaping chute to the feeding/connecting assembly 128. The ramp and guide portion 160 may be formed as a single piece mounted to the bottom wall 118 of the housing 112. The side edges of the ramp and extension may be downturned for added rigidity. The ramp also has an upstream extension or guide plate 161 which extends to the upstream end of the bottom wall 118 of the housing to provide for smooth passage of the stock material to the chute.

The shaping chute 146 has a wide entrance mouth or inlet opening 163 formed or defined by the rear edges of the top, bottom and side walls 152, 154 and 150. The top wall is of generally trapezoidal shape while the bottom wall is generally rectangular in shape, with such walls converging toward one another to define an exit opening 168 at the downstream end of the shaping chute. As the sheet-like stock material is passed through the shaping chute, the side edges thereof are rolled inwardly into generally spiral form and are urged inwardly toward one another so that the inwardly rolled edges form resilient pillow-like crumpled portions of stock material disposed in lateral abutting relationship as they emerge from the exit end of the shaping chute.

The forming member 144 coacts with the shaping chute 146 to ensure proper shaping and forming of the paper (or other suitable stock material), the forming member being operative to guide the central portion of the stock material along the bottom wall 154 of the shaping chute 146 for controlled inward rolling or folding of the side edge portions of the stock material. The forming member projects rearwardly (upstream) of the entry end of the shaping chute for proper guiding of the stock material into the shaping chute. The forming member also extends into the shaping chute with its forward most end disposed relatively close to the underlying bottom wall of the shaping chute adjacent the exit end of the shaping chute, as shown.

The forming member 144 has a pinched U-shape that generally corresponds in appearance to a bobby pin. The bight or base portion 162 of the forming member is rounded and preferably of semi-circular shape. The forming member preferably is made of a suitable material such as plastic which has sufficient flexibility such that the rounded bight portion of the forming member functions as a living hinge permitting adjustment of its lower leg 164 towards and away from the bottom wall 154 of the shaping chute. The upper leg 166 is attached to the top wall 152 of the shaping chute along the center plane thereof by suitable fastening means The lower leg 164 of the forming member extends generally parallel to the bottom wall 154 of the shaping chute. However, the relative inclination and spacing between the lower leg of the forming member and bottom wall of the shaping chute may be adjusted as needed to obtain proper shaping and forming of the lateral edges of the stock material into the relatively low density pillow like portions with the inner edges being overlapped for connection by the feed/stitching mechanism in the front unit. Such adjustment may be effected and then maintained by an adjustment device which is not shown, but which is shown and described in U.S. patent application Ser. No. 08/337,929.

The forming member 144 may be of relatively uniform width. The forming member may be formed, for example, by bending an elongate elastic strip to the shape illustrated. In the illustrated embodiment, the width of the strip is approximately one quarter the width of the exit opening of the shaping chute which in turn is approximately two-thirds of the width of the entry mouth of the shaping chute. The forming member may be otherwise configured. For example, the rearward end portion may be wider than the forward end portion. Moreover, the transition from the narrow forward portion to the wide rear end portion may be progressive such that the lower leg of the forming member has a triangular shape. Similarly, the top leg may have a triangular shape while the rounded bight portion of the forming member may be relatively uniform in width or of reverse hour-glass shape. It is further noted that the forming member may be replaced with other types of forming members, and the chute with other types, such as the triangular forming member and chute shown in U.S. Pat. No. 5,123,889.

The invention likewise encompasses different types of feeding/connecting assemblies which perform a feeding and/or connecting function. However, a preferred feeding/connecting assembly 128 includes a pair of cooperating and opposed gears or gear-like members 170 and 172. The gears 170 and 172, and thus the feeding/connecting assembly 128, perform at least one and preferably two functions in the operation of the machine 110. One function is a "feeding" function, the gears pulling the stock material from a stock roll or other source thereof and then through the forming assembly 126. The material is then discharged by the feeding/connecting assembly through the rectangular opening in the end plate 122. The second function perferably performed by the feeding/connecting assembly 128 is a connecting function. Specifically, the feeding/connecting assembly 128 connects the continuous strip by the two opposing gears coining and preferably perforating the formed stock material along a central band to form a connected strip of cushioning. Other mechanisms may be employed to "connect" the strip, i.e., to operate on the strip in such a manner that it will retain its cushioning properties as opposed to reverting to the original flat form of the stock material. Known connecting mechanisms include mechanisms that crease the stock material to enable the stock material to hold its three-dimensional shape.

The connected strip travels downstream from the feeding/connecting assembly 128 to the severing assembly 134 which divides, for example by cutting, the strip into sections of a desired length. The sections then travel through the post-cutting constraining assembly 140, which includes a converging portion and rectangular tunnel portion. The coined or otherwise connected strip then emerges from the post-cutting constraining assembly where an operator may remove the coined strip from the machine 110.

In preparation for operation of the machine 110, a stock roll is loaded onto the horizontal legs 143*a* forming the stock roll mount. As above indicated, other forms of stock roll mounts may be used, as may be other types of stock material supplies. For example, the stock roll mount may be provided by a cart onto which a roll of stock material may loaded and then the cart rolled into position at the rear end of the machine 110 for supplying stock material to the machine.

The stock material, preferably consisting of two, three or more plies, is passed over a constant feed roller 178 mounted between upper horizontal legs 143*c* of the brackets 143. The plies are then individually passed over separators 180*a–c* of a separator assembly 182. The constant feed roller 1 78 provides a constant point of entry for the stock material regardless of the diameter of the stock roll. The separators 180*a–c* function to separate the plies or layers of stock material prior to passage to the forming assembly 126. Reference may be had to U.S. Pat. Nos. 4,026,198, 4,650, 456, 4,750,896, 5,123,889 and 5,322,477 for further details of the illustrated stock material supply and stock roll holder, as well as for examples of alternative stock material supply arrangements.

Heretofore, the leading portion of the stock material coming from the separators was manually threaded through the forming assembly 126. This threading typically entailed folding the leading portion of the stock material in a triangular-like fashion downstream of the separator assembly 182 and manually pushing this leading portion through the forming assembly (e.g., a forming frame and a converging chute) so that the "point" of the triangle was positioned between the gears 170 and 172 of the feed/connecting assembly 128, after which the feed/connecting assembly is energized to rotate the gears for advancing the stock material through the machine to form a cushioning product. Although effective, this task was somewhat tedious and generally there was a need to provide access to the interior of the machine to enable such manual threading.

This need for hand or manual "threading" of the leading end of the stock material was eliminated by the loading assembly shown and described in copending application Ser. No. 08/478,008. Although such assembly as been proven to perform adequately, the present invention provides an improved loading assembly indicated generally at 190 in FIGS. 1 and 2.

The loading assembly 190 includes a loader feed assembly 192 positioned at the upstream end of the forming assembly, an operator assembly 194 for selectively engaging and disengaging the loader feed assembly with the stock material, and a condition detect device 196 which activates the feed motor 130 or otherwise effects operation or energization of the feeding/connecting assembly 128 when the engaged position of the operator is detected.

Figure 3:
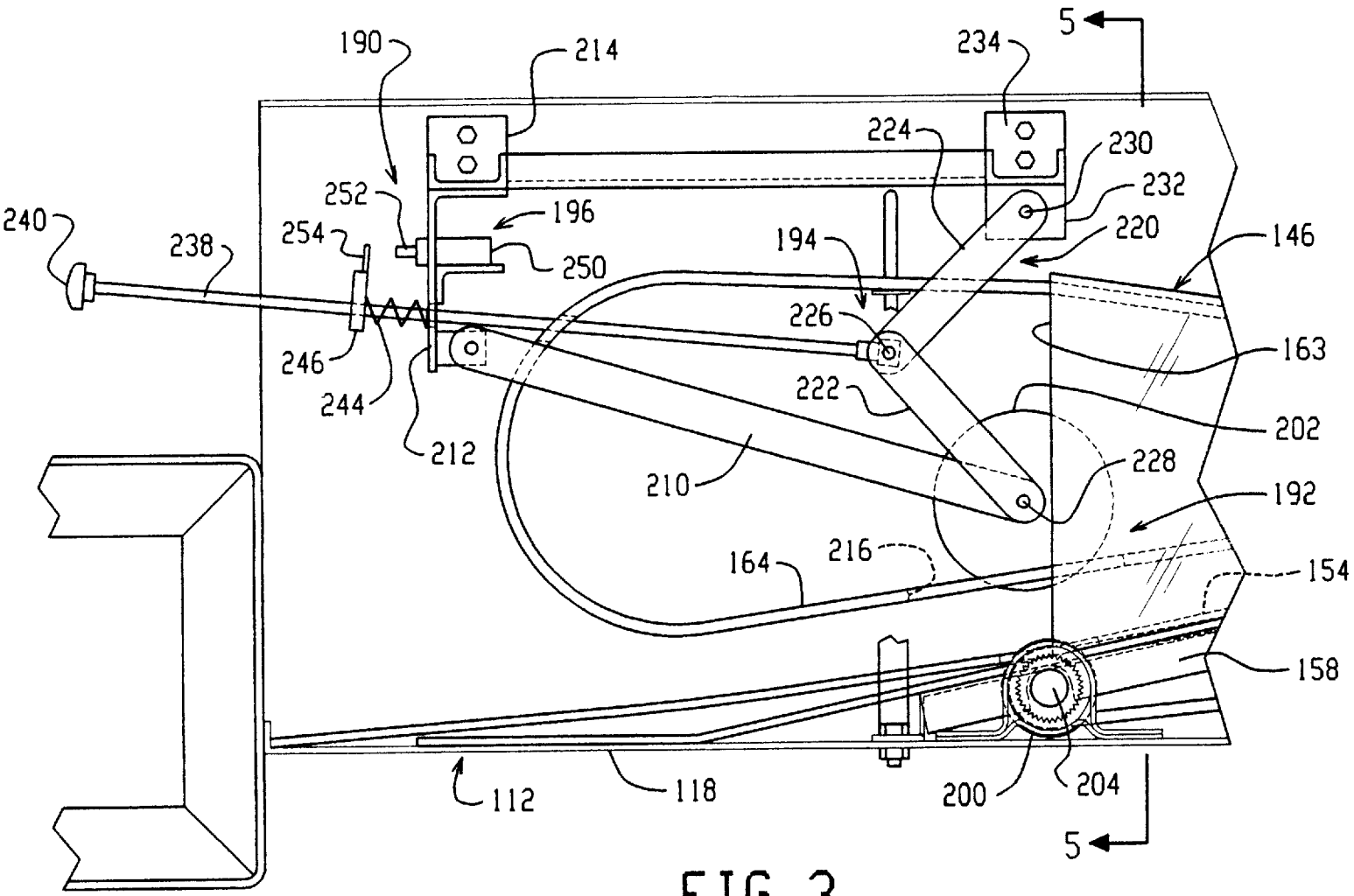
FIG. 3 is an enlarged fragmentary side view of the loading assembly in a non-load or disengaged position.
Figure 4:
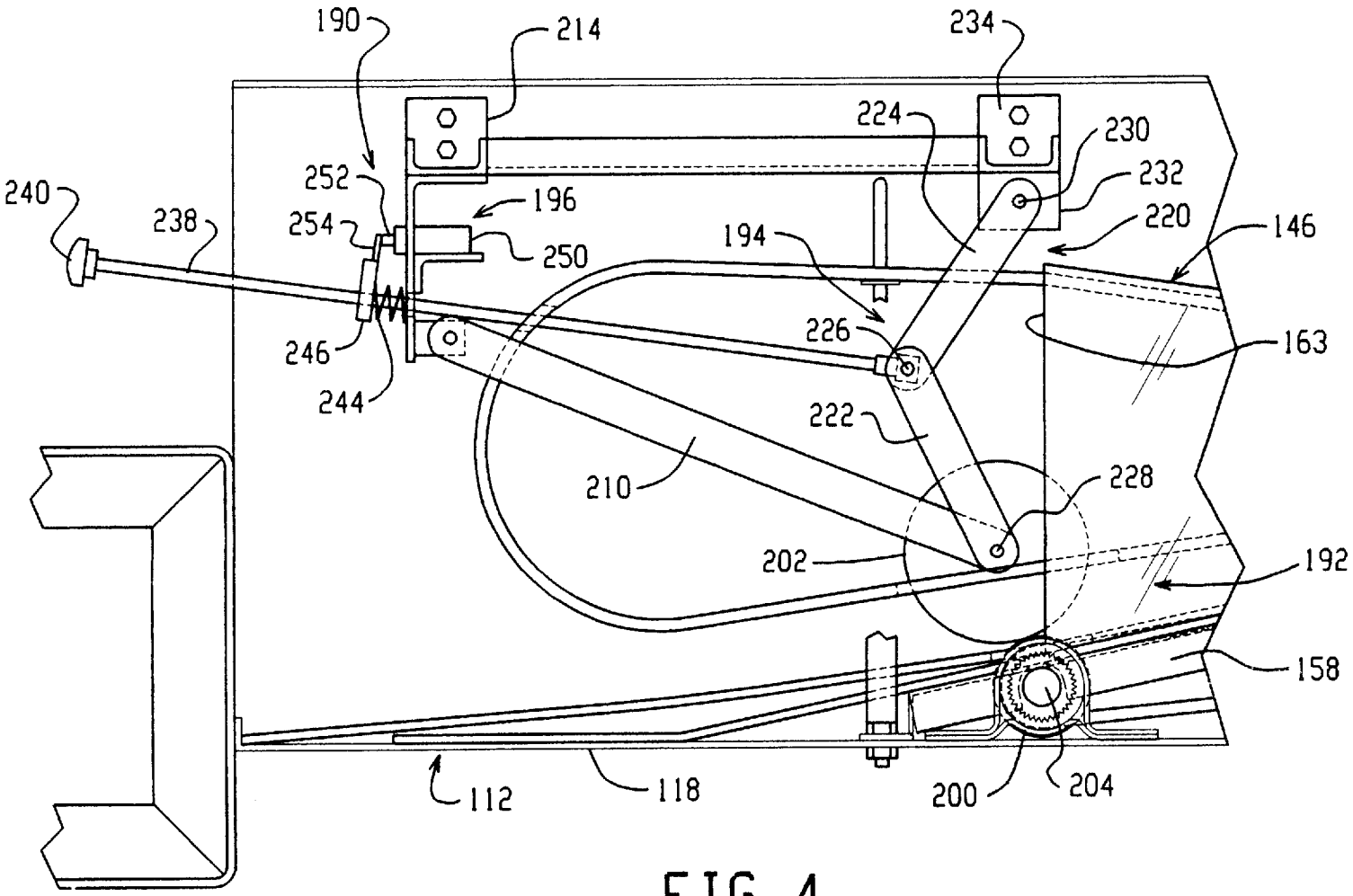
FIG. 4 is a side view of the loading assembly similar to FIG. 3, but showing the loading assembly in a load or engaged position.
Figure 5:
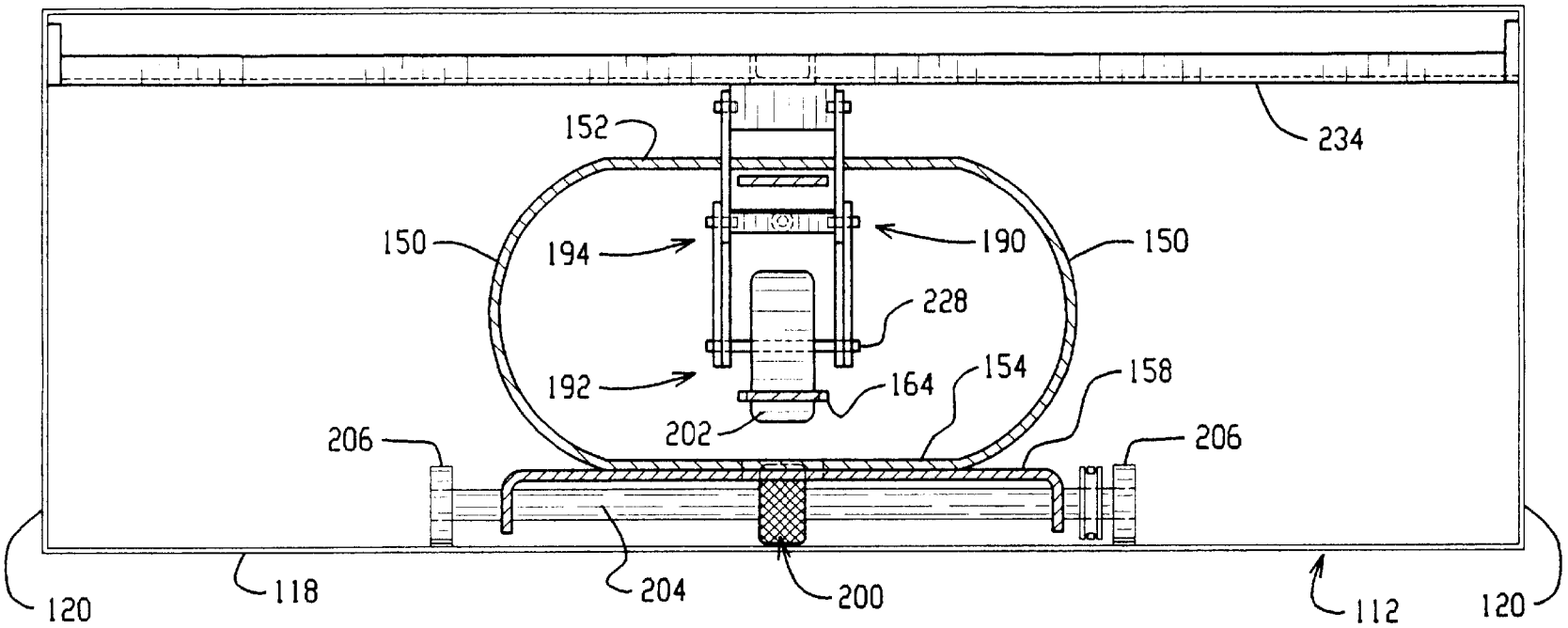
FIG. 5 is a cross-sectional view of the machine taken along the line 5—5 of FIG. 3.

As best seen in FIGS. 3–5, the loader feed assembly 190 includes cooperating feed members including a lower feed roller 200 and an upper pressing roller 202, the latter being rotatably driven in the hereinafter described manner. However, it will be appreciated that both could be notably driven. Although rollers are shown, other types of feed components may be employed such as a moving belt for the feed roller and/or a non-rotating pressing member for the pressing roller.

The rotatably driven feed roller 200 is fixed to a shaft 204 rotatably mounted by bearings 206 secured to the base 118 of the housing 112. As shown, the shaft 204 may pass through holes in the downturned edge portions of the ramp and thus function to hold the upstream end of the ramp in place. The feed roller is positioned such that a portion thereof projects through a slot in the ramp 158 and/or bottom wall 154 of the shaping chute 146. The feed roller and slot are preferably located centrally between the opposed curved side walls 150 of the shaping chute at or adjacent the inlet opening 163 of the chute (including within or without the chute), i.e., closer to the inlet opening than the upstream end of the forming assembly preferably within three inches of the inlet opening, more preferably within two inches and more preferably within one inch and thus aligned longitudinally with the inlet opening of the chute.

The pressing roller 202 is rotatably mounted to the free end of a swing or pivot arm 210 which is pivotally attached at its other end to a bracket 212. The bracket 212 is fixed with respect to the housing 112, as by attachment to a support bar 214 extending laterally between and secured to the side walls 120 of the housing. The swing arm 210 is free to pivot in a plane perpendicular to the bottom wall 154 of the chute 146 for movement of the pressing roller towards and away from the feed roller. As seen in FIG. 5, the pressing roller is aligned with the feed roller 200 for forming therewith a nip in which the center portion of the stock material may be drivingly engaged, the pressing and feed rollers being brought together when engaged by the operator assembly 194. As best seen in FIGS. 3 and 4, the lower leg 164 of the former member 144 has a slot 216 for passage therethrough of the pressing roller as it is moved towards and away from the feed roller in the hereinafter described manner.

Although various devices may be used to move the pressing and feed rollers 202 and 200 into and out of engagement with one another, in the illustrated embodiment the operator assembly 194 includes a toggle 220 composed of a pair of link members 222 and 224 that are pivotally connected at adjacent ends thereof by a pivot element such as a pin 226. As shown, the link members may each comprise a pair of parallel links. The links forming the link member 222, at their outer ends opposite the pin 226, have connected therebetween for rotation the pressing roller 202 in a clevis-like manner by a pin 228 as seen in FIG. 5. The other link member 224 is pivotally connected at its outer end by a pin 230 to a bracket 232. The bracket 232 is fixed with respect to the housing 112 as by attachment to a laterally extending support bar 234 secured between the side walls 120 of the housing 112. Pivotally attached at the center pivot connection 226 of the toggle 220 is a push rod 238 that extends rearwardly to and through a guide opening in the bracket 212 and then out through the upstream end of the housing. The remote end of the push rod 238 is readily accessible at the rear end of the housing and preferably is equipped with a push handle or knob 240.

The push rod 238, and thus the loader feed assembly 192, is biased away from an engaged condition seen in FIG. 4 to a disengaged position seen in FIG. 3. In the illustrated embodiment, this is conveniently accomplished by a spring 244 carried on the push rod and interposed between the bracket 212 and an abutment or follower 246 on the push rod. When the push rod is disengaged, as will be the case during normal operation of the machine, the toggle 220 is contracted to position the pressing roller away from the feed roller.

As will be appreciated, pushing the knob 240 forwardly will cause the link members 222 and 224 to straighten and thus extend the toggle, thereby moving the pressing roller 202 towards and into engagement with the feed roller 200. When the knob is released, the spring 244 will cause the pressing roller to move back to its disengaged ambush position seen in FIG. 3.

When the push rod 238 is moved forwardly sufficiently to engage the pressing roller 202 with the feed roller 200, the condition detect device 196 is actuated to activate the feeding/connecting assembly 128, preferably by turning on and running the feed motor 130 as long as the condition detect device is actuated. In the illustrated embodiment the condition detect device includes a proximity switch, such as a plunger button switch 250, which has the plunger 252 thereof positioned to be depressed by an trigger 254 on the abutment 246 on the push rod 238 when the push rod is pushed to its engaged position of FIG. 4. When the switch closes, the feed motor 130 is energized via suitable electrical circuiting (not shown). The feed motor 130 drives the gears 170 and 172 of the feeding/connecting assembly 128 as previously discussed in connection with FIGS. 1 and 2. Although the condition detect device in the illustrated embodiment includes a plunger switch, it will be appreciated that other devices may be employed such as an electronic position sensor and associated control circuitry.

Figure 6:
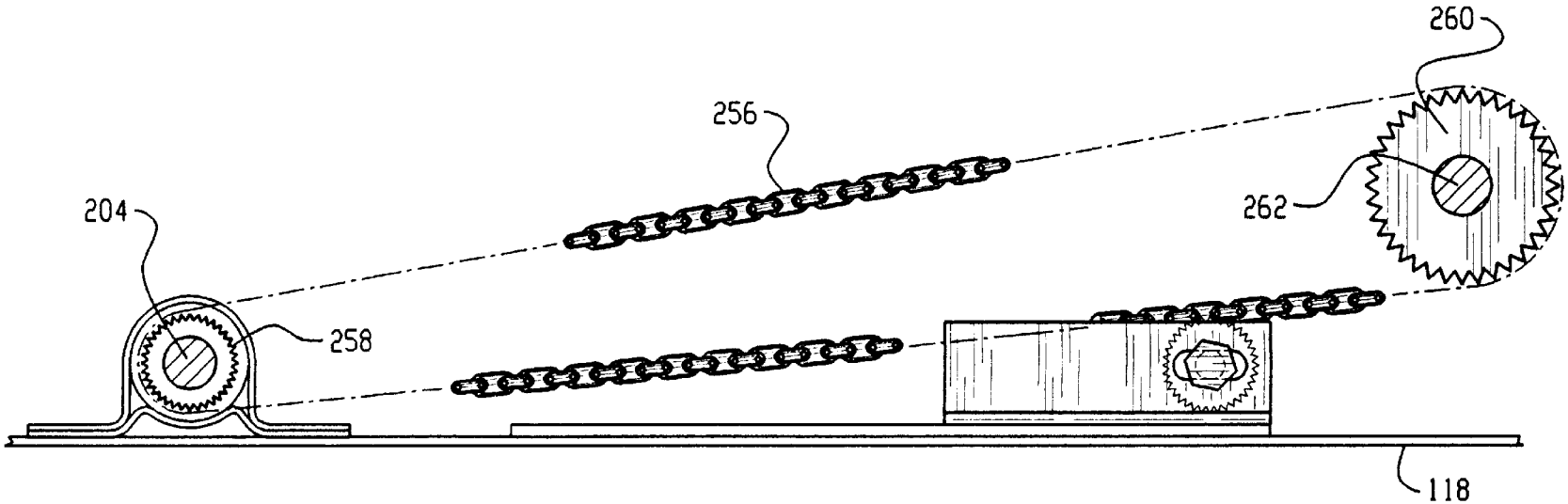
FIG. 6 is a side view of the drive train components of the loading assembly.

At the same time that the feeding/connecting assembly 128 is operated, the feed roller 200 is rotatably driven to feed stock material pinched between the feed roller 200 and the pressing roller 202 into and through the shaping chute 146. The feed roller may be driven in any suitable manner. In the illustrated embodiment, the feed roller shaft 204 is driven by the feed motor 130 via a chain 256 as shown in FIGS. 1 and 6. As shown, the chain 256 is trained about a sprocket 258 on the feed roller shaft and a sprocket 260 on the drive shaft 262 of the feeding/connecting assembly 128. Accordingly, operation of the motor not only rotates the gears 170 and 172 (FIG. 2) in well known manner, but also the feed roller 200. The feed roller 200 preferably has a friction enhancing surface on its outer diameter, such as a knurled surface or a soft rubber surface, for advancing the stock material when the stock material is held against the feed roller by the pressing roller.

Figures 7A, 7B, 7C, 7D, 7E:
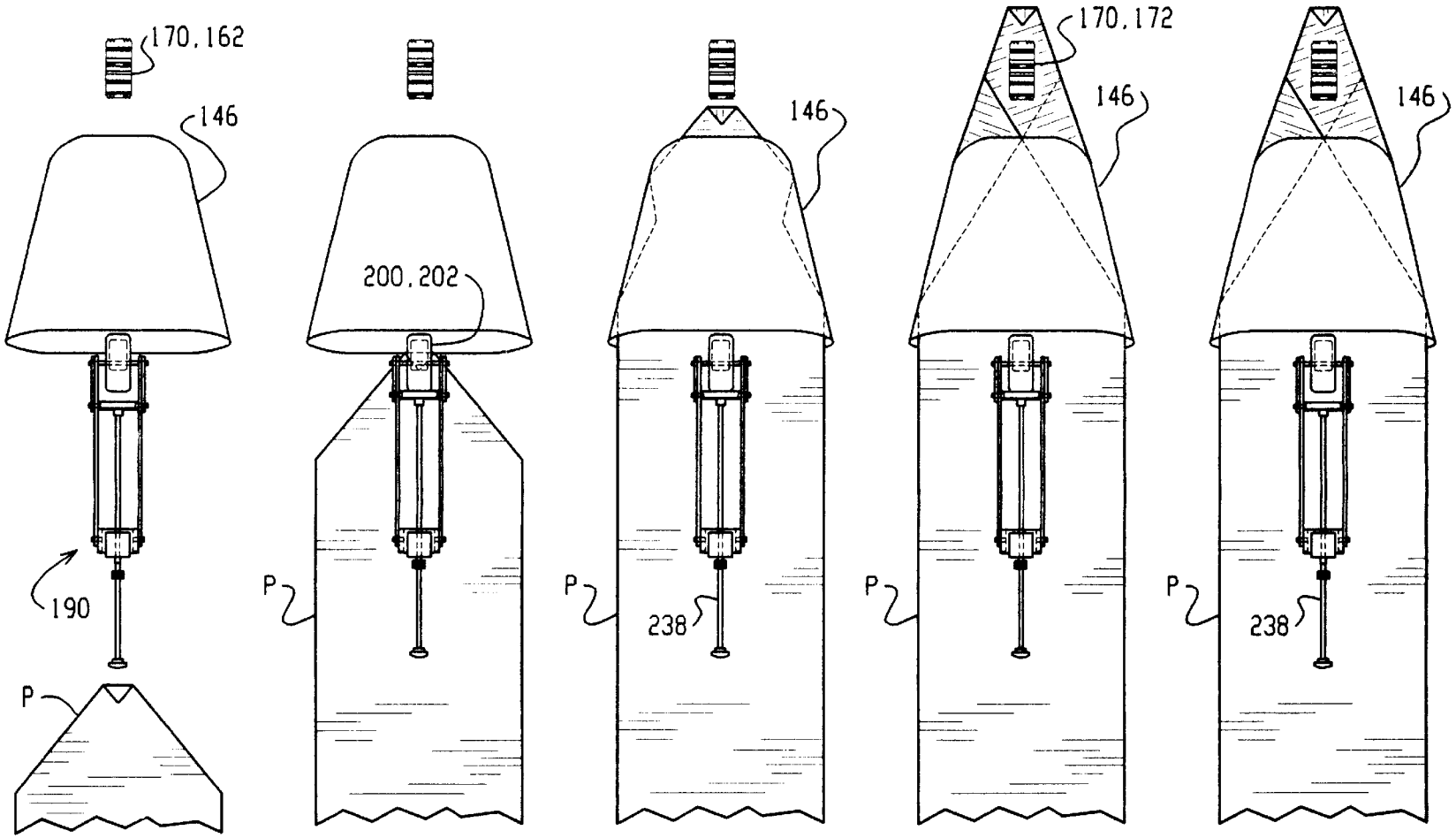
FIGS. 7A–7E are schematic sequential views illustrating a loading method according to the invention.

Referring now to FIGS. 7A–E, an exemplary loading operation is illustrated. As already described above, the leading end of sheet-like stock material P, such as a multi-ply Kraft paper, is pulled from a supply thereof and passed through the separator assembly 158 (FIG. 2). The leading ends of the plies or layers are then brought back together and folded into an arrow-shaped or triangular-like fashion as illustrated in FIG. 7A. The leading end of the stock material is then pushed through the opening in the back of the housing 112 (FIGS. 1–3) underneath the upstream end portion of the former member to position the pointed end thereof between the feed roller 200 (FIGS. 3 and 4) and the pressing roller 202 as illustrated in FIG. 7B. While holding the stock material thus positioned (if needed) with one hand, the operator may use his/her other hand to push the pusher rod 238 forwardly to cause the pressing roller to hold the stock material in engagement with the feed roller and to operate the feed/connecting assembly and rotate the feed roller. The feed roller will push the stock material through the shaping chute 146 as illustrated in FIG. 7C. When the leading pointed end of the stock material has reached the gears 170 and 172 as illustrated in FIG. 7D, the stock material will be engaged by the gears and advanced thereby. At this point the push rod may be released as illustrated in FIG. 7E, the loading operation being completed and the machine now ready to be operated in well known manner to form a cushioning product. Although during normal operation the feed roller 200 will be driven whenever the feeding/connecting assembly 128 is operated, this is of little consequence as the stock material will pass freely thereover when the pressing wheel 202 is moved to its out-of-the way position shown in FIG. 3.

It is contemplated that the conversion machine may be configured for operation in a different mode than that above described wherein the loading assembly is only operated to load paper and not during normal operation of the machine for production of a cushioning product. In this different operational mode, the loading assembly may be continuously engaged during normal operation of the machine so as to pull the paper from the paper supply.

In such different operational mode, the loader feed assembly could be operated to feed the stock material into the converging chute at the same, slower or faster speed than that at which the formed stock material is advanced through the feeding/connecting assembly, the reference to speed being in relation to the rate of advance of the cushioning strip at its respective stages of formation. Operation of the loader feed assembly at the same speed as and continuously with the feeding/connecting assembly would be somewhat difficult to maintain. Typical variations in the stock material would most likely require frequent adjustment of the speed ratio of the loader feed assembly and the feeding/connecting assembly to maintain the same rate of through-put. Operation of the loader feed assembly at a faster speed than the feed/connecting assembly would produce more longitudinal crumpling, but this results in a corresponding reduction in yield, i.e., a greater length of stock material would be required to produce a given length of cushioning product. Operation of the loader feed assembly at a slower speed would assist in maintaining tension on the stock material to maximize the yield by minimizing longitudinal crumpling and further to improve tracking of the stock material though the forming assembly to the feeding/connecting assembly.

Notwithstanding this contemplated different operational mode, use of the loading assembly only during loading and not during normal pad formation is preferred in the case of the illustrated preferred type of conversion machine. During normal pad formation, the loading assembly should not be operatively engaged to maintain relatively independent passage of the plies of the stock material through the forming assembly. If the loading assembly were engaged during normal pad formation, the plies would be held together at least along the center portions thereof passing between the loader feed and pressing rollers such that the plies would tend to crumple more as a unit rather than more independently, such relatively independent crumpling being promoted by the separation of the plies before passage into the forming assembly. As above mentioned, the plies preferably are separated by passage through the separator assembly.

Although the invention has been shown and described with respect to an exemplary embodiment thereof, it is obvious that equivalent alterations and modifications will occur to others skilled in the art upon the reading and understanding of the specification. The present invention includes all such equivalent alterations and modifications.

What is claimed is:

1. A cushioning conversion machine which converts a sheet-like stock material into a cushioning product comprising:

a forming assembly which forms the stock material into a three-dimensional strip of cushioning, the forming assembly including a converging chute through which the stock material is advanced for forming into the three-dimensional strip, the converging chute having an inlet end and an outlet end;

a loader feed assembly located at an upstream end of the forming assembly, the loader feed assembly including cooperating feed members located adjacent the inlet end of the converging chute and between which the stock material passes as it enters the converging chute, the feed members being selectively drivingly engageable with the stock material, whereby the feed members can cooperatively function to pull the stock material from a supply thereof and push the stock material into the converging chute; and a loader operator assembly for selectively engaging and disengaging the feed members with respect to the stock material for selectively feeding the stock material during loading of the machine.

2. A cushioning conversion machine according to claim 1, wherein the forming assembly includes a former member which guides the stock material into and through the converging chute, the forming member extending upstream of the feed members for guiding the stock material to and between the feed members.

3. A cushioning conversion machine as set forth in claim 1, further comprising a housing enclosing the forming assembly and the loader feed assembly, and the loader operator assembly including an operator member extending outside the housing for operation by an operator for loading of stock material into the machine.

4. A cushioning conversion machine as set forth in claim 3, wherein the feed members are mounted in the housing for relative movement towards and away from one another, and the loader operator assembly includes an operator mechanism that is extendable and retractable in response to movement of the operator member to relatively move the feed members towards and away from one another.

5. A cushioning conversion machine as set forth in claim 4, wherein the operator member includes a push rod connected to the operator mechanism.

6. A cushioning conversion machine as set forth in claim 5, including a biasing device which biases the push rod to a disengaged position.

7. A cushioning conversion machine as set forth in claim 1, comprising a feeding/connecting assembly located at a downstream end of the forming assembly which feeds the strip of cushioning passing therethrough during normal operation of the machine, and the feed members when engaged being operative to push the stock material to the feeding/connecting assembly.

8. A cushioning conversion machine as set forth in claim 7, wherein the loader operator assembly includes a position detect device operative when the feed members are engaged to effect energization of the feeding/connecting assembly for operation thereof.

9. A cushioning conversion machine as set forth in claim 8, wherein the forming assembly causes inward rolling of the lateral sides of the stock material to form a strip of cushioning, and the feeding/connecting assembly operates to connect the strip of cushioning along a central band intermediate pillow-like portions, whereby a strip of cushioning product is formed; and further comprising a severing assembly which severs the strip into sections.

10. A cushioning conversion machine as set forth in claim 1, wherein said converging chute is circumferentially continuous.

11. A method of converting a stock material into a cushioning product comprising the steps of:

inserting a leading end portion of the stock material into an upstream end of a cushioning conversion machine to a position adjacent an upstream end of a converging chute forming at least a part of a forming assembly;

using cooperating feed members located adjacent the upstream end of the converging chute to pull the stock material from a supply thereof and to push the stock material through the converging chute and out a downstream end thereof;

then disengaging at least one of the feed members with respect to stock material for normal operation of the machine; and then operating the machine to produce a cushioning product.

12. A method as set forth in claim 11, wherein the inserting step includes guiding the leading end portion of the stock material along a former member of the forming assembly which extends upstream of the feed members, whereby the former member assists in guiding the leading end portion to and between the feed members.

13. A method as set forth in claim 11, wherein the using step includes relatively moving the cooperating feed members toward one another to engage therebetween a portion of the stock material, and driving at least one of the feed members to advance the stock material engaged therebetween.

14. A method as set forth in claim 13, wherein the disengaging step includes moving the feed members apart for relatively free passage of the stock material therebetween.

15. A method as set forth in claim 14, comprising the additional step of energizing a feeding/connecting assembly downstream of the converging chute when the feed members are engaged.

16. A method as set forth in claim 11, wherein the stock material is biodegradable, recyclable and reusable.

* * * * *